US007438460B2

(12) United States Patent
Schmidt et al.

(10) Patent No.: US 7,438,460 B2
(45) Date of Patent: Oct. 21, 2008

(54) MIXING DEVICE WITH VACUUM BOX

(75) Inventors: Gerd-Ulrich Schmidt, Hamm (DE); Theodor Eitzen, Hamm (DE)

(73) Assignee: Hauschild & Co. KG, Hamm (DE)

( * ) Notice: Subject to any disclaimer, the term of this patent is extended or adjusted under 35 U.S.C. 154(b) by 0 days.

(21) Appl. No.: 11/802,764

(22) Filed: May 24, 2007

(65) Prior Publication Data

US 2007/0280038 A1 Dec. 6, 2007

(30) Foreign Application Priority Data

May 24, 2006 (DE) ..... 10 2006 025 643

(51) Int. Cl.
*B01F 9/22* (2006.01)
*B01F 13/06* (2006.01)

(52) U.S. Cl. ..... 366/139; 366/217

(58) Field of Classification Search ..... 366/139, 366/206–219, 143, 602; 433/49, 90–91; 474/112–113; 494/19
See application file for complete search history.

(56) References Cited

U.S. PATENT DOCUMENTS 3,559,961 A * 2/1971 Bergendal ..... 366/348
4,199,866 A * 4/1980 Drury ..... 366/139
4,586,292 A * 5/1986 Carroll et al. ..... 451/329
5,167,448 A * 12/1992 Herold et al. ..... 366/213
6,099,160 A * 8/2000 Flackett ..... 366/217
6,709,151 B2 * 3/2004 Schmidt ..... 366/219
6,733,170 B2 * 5/2004 Mukasa et al. ..... 366/139
6,755,565 B2 * 6/2004 Flackett ..... 366/217
2007/0025180 A1 * 2/2007 Ishii ..... 366/139
2007/0280038 A1 * 12/2007 Schmidt et al. ..... 366/139

FOREIGN PATENT DOCUMENTS

DE 101 43 439 A1 3/2003
JP 11-290668 P * 10/1999
JP 11309358 A * 11/1999
JP 2001246236 A * 9/2001
JP 2004243158 A * 9/2004
JP 2006289254 A * 10/2006
WO WO 2005025717 A1 * 3/2005

* cited by examiner

*Primary Examiner*—Charles E Cooley
(74) *Attorney, Agent, or Firm*—Dowell & Dowell, P.C.

(57) ABSTRACT

A mixing device for mixing liquid, flowable or powder-form materials, having a first component that is mounted in a rotatable manner on a frame, a second component mounted in a rotatable manner on the first component, a drive unit for generating a rotary movement of the first component, and a deflecting unit for transferring and deflecting the rotary movement of the first component to the second component in such a manner that the direction of rotation of the first component is opposite to the direction of rotation of the second component, the second component having at least one vacuum box which can be evacuated when in operation and in which there is at least one container for the materials that are to be mixed.

8 Claims, 4 Drawing Sheets

MIXING DEVICE WITH VACUUM BOX

FIELD OF THE INVENTION

The invention refers to a mixing device for mixing liquid, flowable or powder-form materials, having a first component that is mounted in a rotatable manner, a second component mounted in a rotatable manner on the first component, a drive unit for generating a rotary movement of the first component, and a deflecting unit for transferring and deflecting the rotary movement of the first component to the second component in such a manner that the direction of rotation of the first component is opposite to the direction of rotation of the second component.

BACKGROUND

A mixing device of this type is known from DE 101 43 439 A1. The mixing device described there is a "speed mixer" in which the substances being mixed are mixed under vacuum in single-use trays, glass vials or syringes. However, the containers used in such mixing devices do not have walls that are sufficiently rigid or strong, with the result that they are often deformed or even completely destroyed during the evacuation process.

Mixing under vacuum thus presents difficulties when using mixing devices of the prior art described above.

SUMMARY OF THE INVENTION

The purpose of the present invention is to develop a mixing device of prior art as given above in such a way that it can also be used for mixing processes carried out under vacuum.

The purpose is fulfilled in that the second component has at least one vacuum box which is connected during operation to an evacuation device, and in which there is placed at least one container for the materials that are to be mixed.

Using the mixing device of the invention it is possible to place not only a container containing the materials that are to be mixed, but also the space surrounding the container, under vacuum. This in turn means that the containers used remain intact during the mixing process.

A benefit is that the container is made to fit in the vacuum box. The "customised" positioning of a container in the vacuum box means that the containers are subjected to only small amounts of stress during the mixing process.

In one embodiment of the present invention, the second component is in the form of a vacuum box. In a different embodiment, the second component is a mixing beaker, inside which the vacuum box is positioned in a removable manner. Unlike the first embodiment, the mixing device of the invention in the second embodiment can also be used without the vacuum box. In the first embodiment the entire second component would have to be replaced by a different second component with a mixing beaker.

It is also beneficial for the vacuum box to have a transparent lid. By this means it is possible to observe the inserted container during the mixing process.

Other benefits are given in the characteristics of the other sub-claims.

In one aspect, there is provided mixing device for mixing liquid, flowable or powder-form materials, having a first component that is mounted in a rotatable manner on a frame, a second component mounted in a rotatable manner on the first component, a drive unit for generating a rotary movement of the first component, and a deflecting unit for transferring the rotary movement of the first component to the second component in such a manner that the direction of rotation of the first component is opposite to the direction of rotation of the second component, the second component having at least one vacuum box with a box extension which can be evacuated when in operation and in which there is at least one container for the materials that are to be mixed, the container closed by a container lid and fitted in the vacuum box in such a way that, upon evacuation of the vacuum box, a negative pressure is generated exclusively in a free space of the box extension between the vacuum box and the container lid.

One embodiment of the present invention is described in greater detail below by means of the drawings.

DETAILED DESCRIPTION

Figure 1:
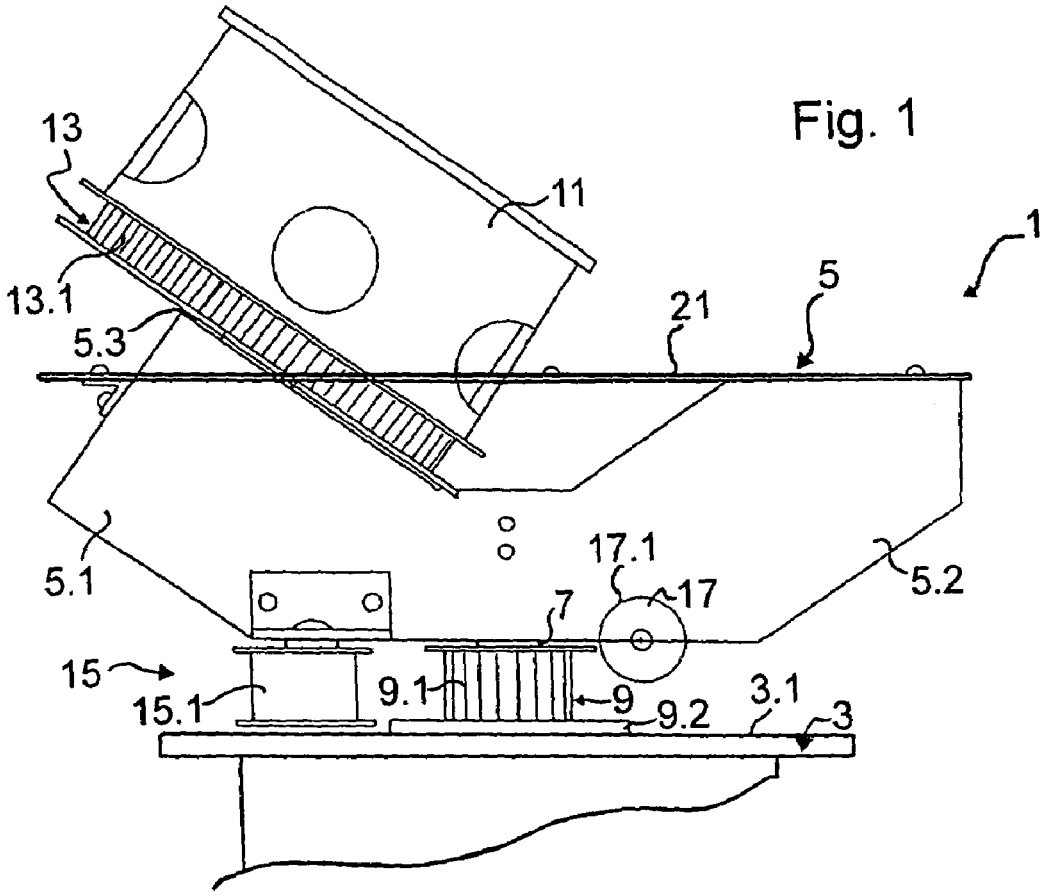
FIG. 1 shows a side view in diagram form of a first and second component in accordance with the present invention.

In FIG. 1 the top area of a mixing device 1 is shown in side view in diagram form. A first component 5 in the form of a rotary arm is mounted on a frame 3 so that it is able to rotate, and has an axis of rotation D1. The rotary arm 5 is located in a non-rotating manner on the shaft 7 of a drive unit (not shown), which can be integrated into the frame 3. The axis of rotation of the shaft coincides with the axis of rotation D1, and is also designated D1 below.

A V-belt pulley 9 is mounted on the frame 3 on a frame surface 3.1 opposite the rotary arm 5 so that it is unable to rotate. The V-belt pulley 9 has an opening through it (not shown) for the shaft 7 and is positioned concentrically to the axis of rotation D1 of the shaft 7 with a radial effective surface 9.1 which has V-shaped indentations. The securing of the V-belt pulley 9 to the surface 3.1 is effected by bolting a base area 9.2 to the frame 3. However, any other means of securing known in prior art can also be used.

The rotary arm 5 can have any basic shape required. In the present embodiment, the rotary arm 5 has two side pieces 5.1 and 5.2. The side piece 5.1 extends in a perpendicular plane through the axis of rotation D1, with a main axis at an angle—the setting angle—of between 0 and 90° radially to the axis of rotation D1 of the shaft 7. A second component 11 is mounted so that it is able to rotate on a surface 5.3 of the side piece 5.1, which surface is suitably angled and is aligned perpendicular to the vertical plane; the second component has an axis of rotation D2.

The second component 11 is in the form of a mixing beaker for holding mix material. Because of the angled position of the side piece 5.1 there is an angular relationship between the axis of rotation D1 of the first component 5 and the axis of rotation D2 of the second component 11. At its base—i.e. at the end of the second component 11 that is opposite to the surface 5.3 of the side piece 5.1—the periphery of the second component 11 is made in the form of a V-belt pulley 13 and is thus connected to the second component 11 in a non-rotating manner. The V-belt pulley 13 has a radial effective area 13.1 that is concentric with the axis of rotation D2 and has V-shaped indentations.

A first axial deflector element 15 is positioned on the rotary arm 5 at the side of the side piece 5.1, and is mounted on the rotary arm 5 in a rotatable manner. In the present embodiment the axis of rotation of the first deflector element 15 lies parallel to the axis of rotation D1. The first deflector element 15 has a radial smooth effective area 15.1 concentric to its axis of rotation, which area lies in a horizontal plane with the effective area 9.1 of the V-belt pulley 9. Not visible in FIG. 1, there is a second axial deflector element 15 behind the first axial deflector element 15 that is exactly the same as the first axial deflector element 15 and is positioned in the same relation to the V-belt pulley 9 and the effective area 9.1 of the latter. The two deflector elements 15 are positioned symmetrically to the V-belt pulley 9. When viewed from the top, an imaginary connection of the axes of rotation of the two deflector elements 15 and the axis of rotation D1 form an equilateral triangle, the imaginary connection between the two axes of rotation of the deflector elements 15 forming the base side of this triangle.

On the underside of the rotary arm 5 in the area of the side piece 5.2 there is also a radial deflector element 17. In the present embodiment the radial deflector element 17 has an essentially horizontal axis of rotation and a radial smooth effective area that is concentric with it. The radial effective area meets, at one point, an imaginary horizontal centre plane of the effective area 9.1 of the V-belt pulley 9. In FIG. 1 a second axial deflector element 17 is positioned directly behind the radial deflector element 17 on the other side of the rotary arm 5. This second axial deflector element 17 is exactly the same as the axial deflector element 17 illustrated, and is positioned in the same relation to the V-belt pulley 9 and the effective area 9.1 of same. The two radial deflector elements 17 are positioned symmetrically to the axis of rotation D1.

Figure 2:
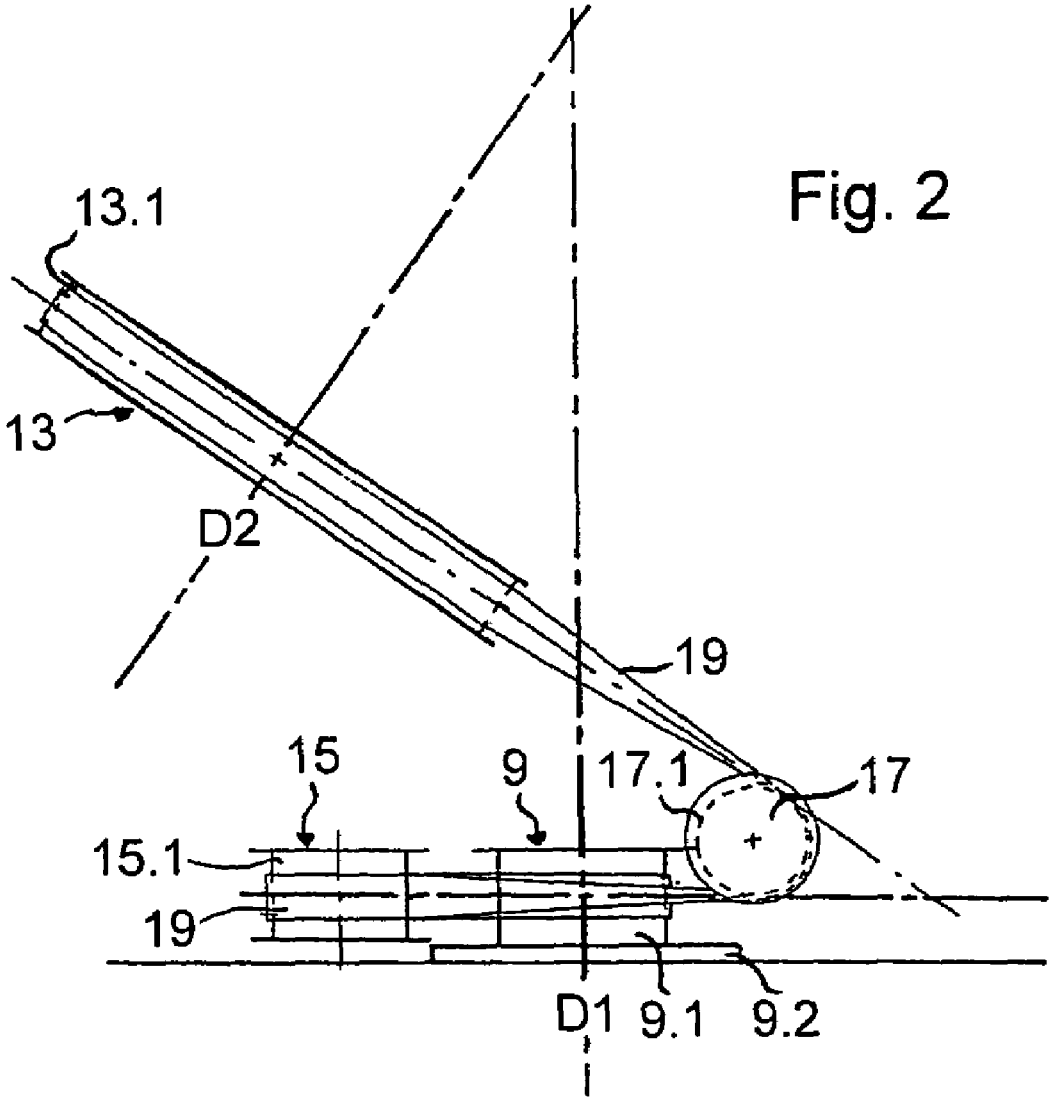
FIG. 2 shows a side view in diagram form of a deflecting device in accordance with the present invention.

FIG. 2 shows, in diagram form, the deflection mechanism. The deflection mechanism is formed by a deflection device which in the present embodiment is made up of the first V-belt pulley 9, the two axial deflector elements 15, the two radial deflector elements 17 and the V-belt pulley 13. These components of the deflection device are connected effectively to one another by means of a flexible belt element 19 in the form of a V-belt. The wedges of the continuous V-belt 19 engage with the indentations of the effective area 9.1 of the V-belt pulley 9, and the belt runs with its smooth side around part of the periphery of the effective areas 15.1 of the two axial deflector elements 15 and, also with its smooth side, round part of the periphery of the effective area 17.1 of the radial deflector elements 17, and finally runs with its wedged side round part of the periphery of the effective area 13.1 of the V-belt pulley 13. As the rotary arm 5 rotates about the axis of rotation D1, the rotary movement is transferred via the deflector device to the second component 11, the mixing beaker, in the opposite direction of rotation.

FIG. 2 shows the axes of rotation D1 and D2 in their angular relationship to each other, and the diameters of the components of the deflector device. By the appropriate choice of the angular relation between D1 and D2 and by the appropriate choice of the diameters, different rotational speeds can be set, depending on the material to be mixed, without changing the fundamental structure. By using the deflector device of the present invention as described, there is regularly a gearing down of the rotational speed of the first component 5 to the second component 11. However, in theory it is also possible in suitable cases to design the deflector device in such a way that a gearing up process takes place. It is also possible for the deflector device to have more than two axial and/or radial deflector elements 15, 17. There can also be additional deflector devices between the axial deflector devices 15 and the radial deflector devices 17 and between the radial deflector devices 17 and the V-belt pulley 13, the effective areas of which additional devices taking up angular positions between those of the effective areas 15.1, 17.1 and 13.1 in order to support and guide the V-belt 19.

A turntable 21 is positioned on the upper side of the rotary arm 5 (FIG. 1) and has an opening into which the second component 11 partly engages.

Figure 3:
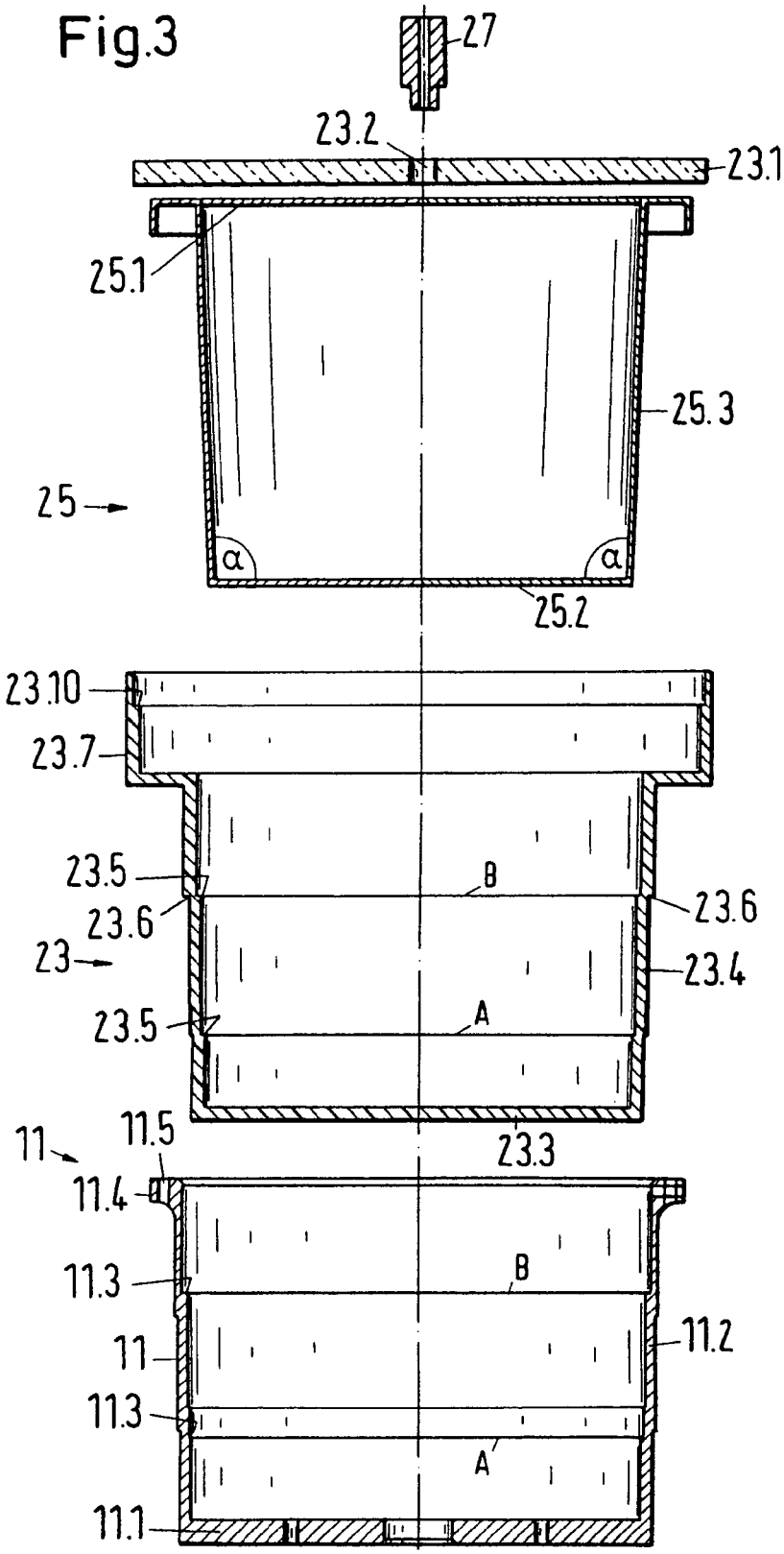
FIG. 3 is an exploded view in diagram form of a second component in the form of a mixing beaker, the vacuum box and a container, in accordance with the present invention.

FIG. 3 shows, in diagram form, an exploded view of the second component 11 of the invention with its separate parts.

Figure 4:
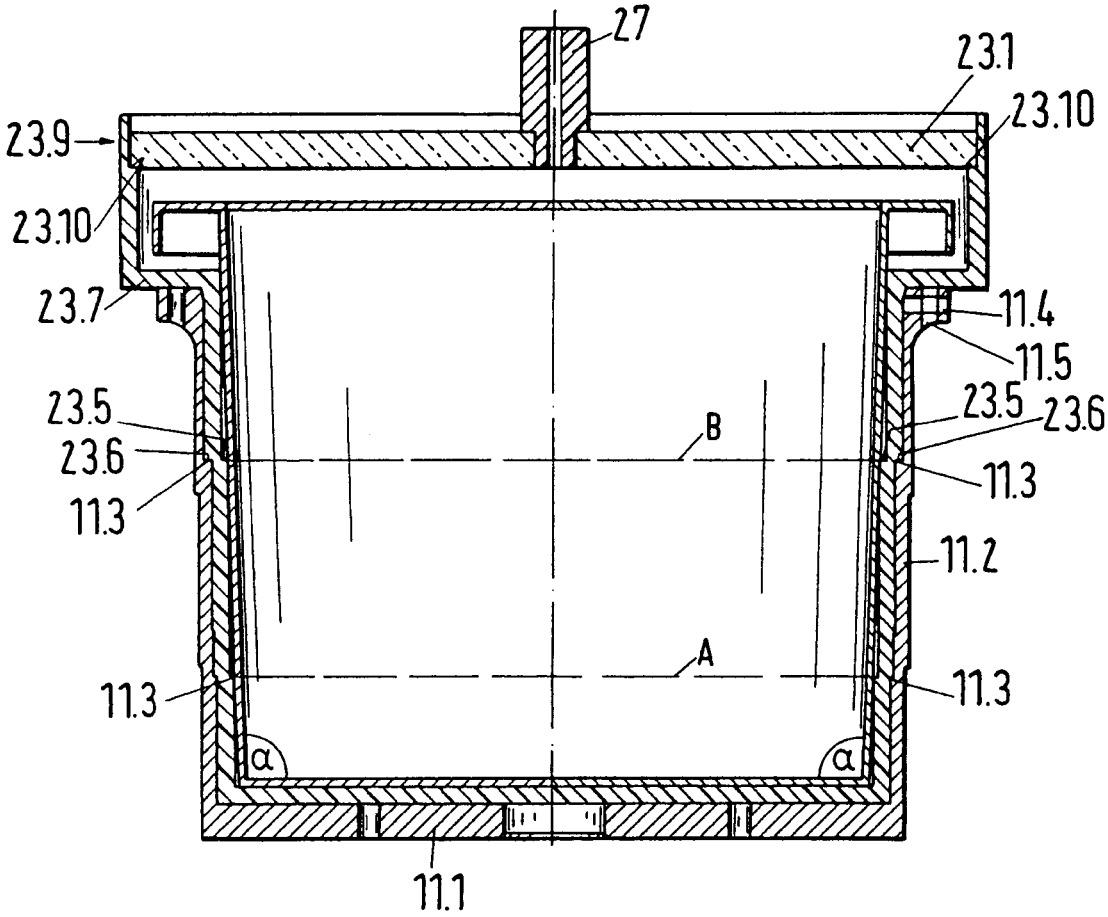
FIG. 4 is a cross-section in diagram form through the second component as shown in FIG. 1, with the vacuum box and container inserted.

The second component 11 is in the form of a mixing beaker, into which is inserted a vacuum box 23. In the preferred embodiment illustrated, the vacuum box 23 is made to be an exact fit for the mixing beaker 11 or the interior of the mixing beaker 11 (FIG. 4). Into the vacuum box there is inserted a container 25 which, in the present embodiment, is in the form of a bucket. The container 25 contains a material that is to be mixed (not shown), and can be closed by means of a lid 25.1.

The vacuum box 23 can be closed by means of a box lid 23.1 In the embodiment shown, the box lid 23.1 is transparent or clear, but in different embodiments can also be opaque.

The box lid 23.1 has a central opening 23.2 into which can be inserted, in a sealed manner, a connector 27 for a vacuum tube. The connector 27 can be joined up to a tube (not shown) or similar that creates a connection to an evacuation device (not shown).

In FIG. 4 the components described in FIG. 3 are shown in their assembled state.

The second component 11 has a base 11.1 and at least one component side wall 11.2. On its inner side the component side wall 11.2 has a number of component shoulders 11.3, each of which lies in a plane A, B parallel to the base 11.1. At its open end the component side wall 11.2 forms a flange 11.4, in which there can be openings 11.5 for securing devices (not shown) for different inserts. The component shoulders 11.3 and the flange 11.4 form a supporting surface for the vacuum box 23.

The vacuum box 23 also has a base 23.3 and at least one box side wall 23.4. The number of box side walls 23.4 is the same as the number of component side walls 11.2 of the second component 11. Where the geometrical shape is circular, as in the present case, there is thus only one component side wall 11.2 and one box side wall 23.4.

The box side wall 23.4 has box shoulders 23.5 on the inside and corresponding box overhangs 23.6 (see also FIG. 3) on the opposite outer surface; in the assembled state as shown in FIG. 4 each of these lies in the same plane A, B as one of the component shoulders 11.3. The dimensions of the box overhangs 23.6 are complementary to the component shoulders 11.3, so that the box overhangs 23.6 on the outside of the vacuum box 23 lie exactly on the shoulders 11.3 on the inner wall of the second component when the vacuum box 23 is inserted into the second component 11.

In its top part the vacuum box 23 has a box extension 23.7 with an outer surface that lies exactly against an outer surface of the flange 11.4. At its open end 23.9 the box extension 23.7 forms, on the inside, an extension shoulder 23.10 on which the vacuum lid 23.1 lies to form a seal during operation.

A container 25 in the form of a bucket is placed into the vacuum box 23. The container 25 also has a base side 25.2 and at least one container side wall 25.3. In the case of the container 25 also, the number of container side walls 25.3 is the same as the number of component side walls 11.2. The container side wall 25.3 does not sit perpendicular on the base side 25.2, but at an angle a that in cross-section is slightly greater than 90°. As a result, the container 25 has a smaller cross-sectional width at the base than at the lid side. It can be seen in FIG. 4 that the container side wall 25.3 goes upwards from the base 25.2 at such an angle a that the container side wall 25.3 lies up against the inside wall of the vacuum box 23 at the level of the box shoulders 23.5 and at the start of the box extension 23.7. In its inserted state the container 25 extends with its container lid 25.1 peripherally into the larger space of the box extension 23.7, albeit with a space towards the inside wall of the box extension 23.7. An open space remains also between the container lid 25.1 and the box lid 23.1. By means of the vacuum tube connector 27 and the evacuation device (not shown) that is connected to it, negative pressure is created in the open space of the box extension 23.7 around the container lid 25.1, the level of which pressure can be set at the evacuation device.

Because of the exactly-fitting position of the container 25 in the vacuum box 23, and of the latter in turn in the second component 11, the negative pressure has very little effect on the shaping of the container 25.

In alternative embodiments the second component 11 can also be made directly as a vacuum box 23, so that it is not necessary to make the second component in the form of a mixing beaker.

What is claimed is:

1. Mixing device for mixing liquid, flowable or powder-form materials, having a first component that is mounted in a rotatable manner on a frame, a second component mounted in a rotatable manner on the first component, a drive unit for generating a rotary movement of the first component, and a deflecting unit for transferring the rotary movement of the first component to the second component in such a manner that the direction of rotation of the first component is opposite to the direction of rotation of the second component, the second component having at least one vacuum box with a box extension which can be evacuated when in operation and in which there is at least one container for the materials that are to be mixed, said container closed by a container lid and fitted in said vacuum box in such a way that, upon evacuation of said vacuum box, a negative pressure is generated exclusively in a free space of said box extension between said vacuum box and said container lid.

2. Mixing device as in claim 1, wherein the container is made to fit in the vacuum box.

3. Mixing device as in claim 1, wherein the second component is a mixing beaker in which the vacuum box is positioned in a removable manner.

4. Mixing device as in claim 3, wherein the vacuum box is made to fit into the mixing beaker.

5. Mixing device as in claim 1, wherein the vacuum box has a transparent box lid.

6. Mixing device as in claim 5, wherein the box lid has a connection for a vacuum tube connector.

7. Mixing device as in claim 1, wherein each container has a container lid.

8. Mixing device as in claim 1, wherein there is at least one seal-forming shoulder in the vacuum box.

* * * * *